US006866166B2

(12) United States Patent
Mehes et al.

(10) Patent No.: US 6,866,166 B2
(45) Date of Patent: Mar. 15, 2005

(54) CUP CADDY FOR LIQUID DISPENSERS

(76) Inventors: Paul L. Mehes, 7465 Fairmount Rd., Novelty, OH (US) 44072; Daniel H. Bloom, 24601 Priscilla Dr., Dana Point, CA (US) 92629

( * ) Notice: Subject to any disclaimer, the term of this patent is extended or adjusted under 35 U.S.C. 154(b) by 0 days.

(21) Appl. No.: 10/633,896

(22) Filed: Aug. 4, 2003

(65) Prior Publication Data

US 2005/0029303 A1 Feb. 10, 2005

(51) Int. Cl.[7] ..... B67D 1/07

(52) U.S. Cl. ..... 222/192; 222/94; 222/132; 222/321.7

(58) Field of Search ..... 222/192, 94, 105, 222/129, 130, 131, 132, 183, 321, 7, 321.9; 221/96, 98, 92; 206/223

(56) References Cited

U.S. PATENT DOCUMENTS

| | | | | | |
|---|---|---|---|---|---|
| 1,778,248 | A | * | 10/1930 | Doughty | 222/132 |
| 3,331,533 | A | * | 7/1967 | Krugger | 221/96 |
| 3,349,960 | A | * | 10/1967 | Ketler | 221/96 |
| 3,434,629 | A | * | 3/1969 | Hooge et al. | 222/88 |
| 3,469,739 | A | | 9/1969 | Phillips | |
| 3,604,592 | A | | 9/1971 | Bacon | |
| 3,896,977 | A | * | 7/1975 | Bergstrom | 222/353 |
| 3,987,932 | A | | 10/1976 | Maldon | |
| 4,280,643 | A | * | 7/1981 | Cordova et al. | 294/141 |
| 4,323,172 | A | * | 4/1982 | Lim | 222/130 |
| 4,874,113 | A | * | 10/1989 | Schmidt | 222/143 |
| 4,889,261 | A | | 12/1989 | Conrad | |
| 5,228,595 | A | | 7/1993 | Booker | |
| D339,944 | S | | 10/1993 | Slomiana | |
| 5,275,305 | A | | 1/1994 | Gross | |
| 5,277,332 | A | | 1/1994 | Rogers | |
| 5,301,833 | A | | 4/1994 | Aycan | |
| 5,439,104 | A | * | 8/1995 | Wolska-Klis | 206/233 |
| 5,713,492 | A | * | 2/1998 | DeGennaro | 222/153.03 |
| 2001/0035426 | A1 | | 11/2001 | Chamorro | |

* cited by examiner

*Primary Examiner*—Frederick Nicolas
(74) *Attorney, Agent, or Firm*—Rankin, Hill, Porter & Clark LLP

(57) ABSTRACT

The present invention provides a cup dispenser for holding cups adjacent to the dispenser. The cup dispenser is designed for use with a bottle having a liquid dispenser mounted thereon, and includes a saddle and a holder. The saddle includes a top panel including an opening sized to accommodate the liquid dispenser of the bottle, and one or more side panels connected to and extending downwardly from the top panel. When the liquid dispenser is inserted through the opening, the saddle engages the bottle. The holder extends from a side panel and is configured to receive a plurality of vertically stacked cups. There are many advantages associated with the cup dispenser of the present invention. Dispensing liquids such as mouthwashes, fluoride solutions, medications, and refreshments becomes more convenient and more sanitary using the cup dispenser of the present invention.

8 Claims, 3 Drawing Sheets

CUP CADDY FOR LIQUID DISPENSERS

BACKGROUND OF THE INVENTION

1. Field of Invention

The present invention relates to a cup dispenser, and more particularly to a cup dispenser configured to attach to a bottle having a liquid dispenser mounted thereon.

2. Description of Related Art

Liquids such as mouthwashes, fluoride solutions, medications, and refreshments are often dispensed into disposable cups. For example, in the facilities of professional oral care providers, there is a need to supply cups for mouth rinsing. Often, the cups are placed on a table or countertop next to a liquid dispenser. However, tables and countertops are not the most sanitary locations for stacks of disposable cups. Cup users must handle the entire stack of cups to remove a cup from the stack. Additionally, the cups contact the surfaces and are exposed to microorganisms and debris that remain on the surfaces even though the surfaces appear clean to the naked eye. Other cup users and unsanitary surfaces foster the spread of diseases.

A convenient location for disposable cups is also desirable, as cups that are not placed in dispensers or on countertops are often located far from the liquid dispenser. Additionally, a practical and sanitary method of storing disposable cups in close proximity to a liquid dispenser is advantageous in the facilities of oral health care providers, as well as in restaurant and office restrooms, and residential kitchens and bathrooms.

Currently, there are many commercially available cup holders. One design for a cup holder mounts to a wall and is adapted to hold a vertical stack of disposable cups. This design for a cup holder is generally cylindrical and has opposing top and bottom openings, where a stack of cups may be inserted through the top opening, and cups are dispensed through the bottom opening. Disadvantages to the wal-mount design include the location of the cups and the damage to the wall should the cup holder be removed or moved to a new location. With a wall-mount design, the cups may not be in close proximity to the liquid dispenser. There exists a need for an efficient and sanitary portable cup holder that is in close proximity to a liquid dispenser.

SUMMARY OF THE INVENTION

The present invention provides a cup dispenser for holding cups adjacent to the dispenser. The cup dispenser is designed for use with a bottle having a liquid dispenser mounted thereon, and may be configured for use with bottles of different shapes and sizes. The cup dispenser comprises a saddle and a holder. The saddle comprises a top panel and one or more side panels connected to and extending downwardly from the top panel. The top panel has an opening sized to accommodate the liquid dispenser of the bottle. When the liquid dispenser is inserted through the opening, the saddle engages the bottle.

The holder extends from a side panel and is configured to receive a plurality of vertically stacked cups. In a preferred embodiment, the holder is generally cylindrical and comprises a dispensing end and a loading end. The dispensing end comprises a dispensing aperture sized to engage a cup while allowing the cup to pass through the dispensing aperture when force is applied to the cup. The loading end comprises a loading aperture sized to allow a vertical stack of cups to pass through the loading aperture without resistance.

There are many advantages associated with the cup dispenser of the present invention. Dispensing liquids such as mouthwashes, fluoride solutions, medications, and refreshments becomes more convenient and more sanitary using the cup dispenser of the present invention. For example, in an oral care provider's facility, the cup dispenser saves space by not requiring a separate location for cup storage, and provides a safer and more sanitary way to administer mouthwashes and other liquids using disposable cups. Restaurant patrons and office building occupants could benefit from the cup dispenser of the present invention as it provides a convenient and sanitary method of providing courtesy mouthwash in restrooms. The benefits of mouthwash include decreasing the bacteria population in the mouth, leading to fresher breath and healthier teeth and gums. The benefits of mouthwash could be more easily experienced by people in their homes, as using mouthwash would become simpler and more sanitary. Many people who use mouthwash in their homes utilize the cap as a cup, which creates unsanitary dispensing conditions. Disposable cup storage can be problematic in the home, and cup dispenser of the present invention can eliminate the convenience and sanitation concerns with home mouthwash use. The foregoing and other features and advantages of the invention are fully described hereinafter. The accompanying drawings constitute a part of the specification and illustrate an exemplary embodiment of the invention.

DETAILED DESCRIPTION OF THE PREFERRED EMBODIMENTS

Figure 1:
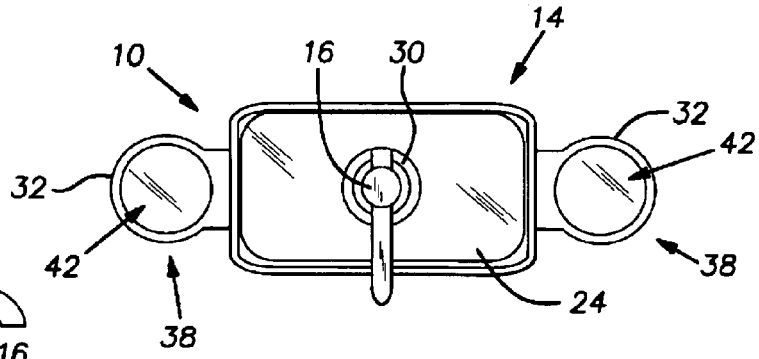
FIG. 1 is a top view of a cup dispenser according to one embodiment of the invention.
Figure 2:
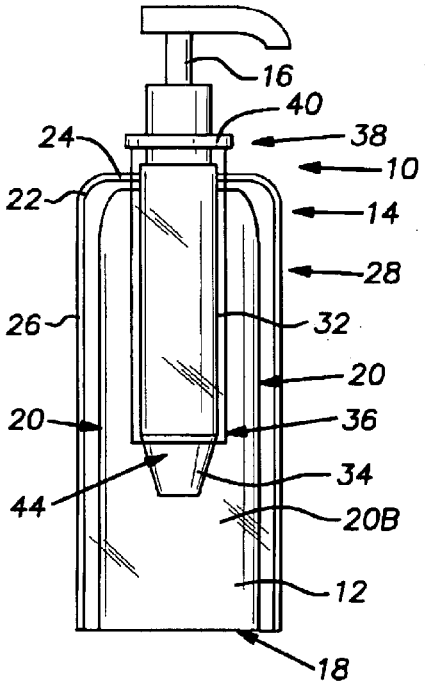
FIG. 2 is a side view of the cup dispenser of FIG. 1.
Figure 3:
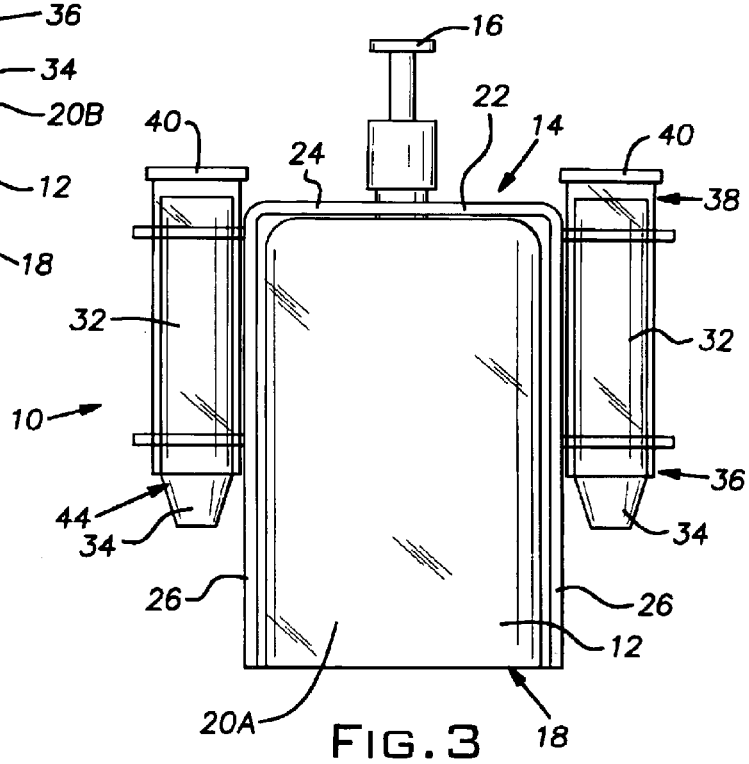
FIG. 3 is a front view of the cup dispenser of FIG. 1.

FIGS. 1–3 illustrate a first preferred embodiment of a cup dispenser 10 according to the present invention. The cup dispenser 10 is designed for use with a bottle 12 having a top 14 with a liquid dispenser 16 mounted thereon, and a base 18 connected to the top 14 by one or more sides 20.

The cup dispenser 10 comprises a saddle 22 and a holder 32. The saddle 22 comprises a top panel 24 and one or more side panels 26 connected to and extending downwardly from the top panel 24. The embodiment illustrated in FIGS. 1–3 shows two side panels 26 located on opposing sides of the top panel 24. The top panel 24 and side panels 26 cooperate to form a housing 28 that covers the top 14 of the bottle 12 and two sides 20 of the bottle 12, the top panel 24 having an opening 30 sized to accommodate the liquid dispenser 16 of the bottle 12. When the liquid dispenser 16 is inserted through the opening 30, the saddle 22 engages the bottle 12. An example of a preferred liquid dispenser is a pump, as the bottle 12 does not need to be overturned to dispense the liquid. The top panel 24 is generally parallel to the base 18 of the bottle 12 when the saddle 22 engages the bottle 12. The cup dispenser 10 may be attached to a bottle 12 by inserting the liquid dispenser 16 through the opening 30 in the top panel 24 of the saddle 22, and may be removed from the bottle 12 by lifting the saddle 22 from the top 14 of the bottle 12.

The holder 32 extends from a side panel 26 and is configured to receive a plurality of vertically stacked cups 34. In a preferred embodiment, the holder 32 has a generally cylindrical central cavity defined by a longitudinal axis, and comprises a dispensing end 36 and a loading end 38. The dispensing end 36 comprises a dispensing aperture 44 sized to engage a cup 34 while allowing the cup 34 to pass through the dispensing aperture 44 when force is applied to the cup 34. The loading end 38 comprises a loading aperture 42 sized to allow a vertical stack of cups 34 to pass through the loading aperture 42 without resistance.

In an alternate embodiment, the holder 32 may comprise one aperture instead of two apertures for loading and dispensing cups 34. In this alternate embodiment, the holder 32 includes only the dispensing aperture 44. The cups 34 are loaded into the holder 32 through the dispensing aperture 44 and are also dispensed through the dispensing aperture 44. In such an embodiment, the cups 34 are loaded into the holder by pushing the cups 34 through the dispensing aperture 44. One or more cups 34 may be removed from the holder 32 by pulling a cup 34 through the dispensing aperture 44.

In the embodiment illustrated in FIGS. 1–3, the cup dispenser 10 includes two holders 32, each holder 32 extending outwardly from one of the side panels 26. The cup dispenser 10 may include one or more additional holders 32, each holder 32 extending outwardly from each side panel 26. A plurality of cups 34 may be inserted into the holder 32 through the loading aperture 42. Each holder 32 further comprises a removable cover 40 that engages the loading end 38 and covers the loading aperture 42. When the removable cover 40 is attached to the loading end 38 of the holder 32, the removable cover 40 serves to prevent unsanitary matter from entering the holder 32 through the loading aperture 42 and contacting the cups 34 while the cups are disposed within the holder 32.

FIGS. 1–3 illustrate an embodiment of the cup dispenser 10 engaged with a bottle 12 having a base 18 that is generally rectangular in shape, and having four sides 20, similar to a rectangular prism. As the base 18 of the bottle 12 is generally rectangular, the bottle 12 has two pairs of sides 20, and each pair of sides 20 having different dimensions than the other pair of sides 20. The first pair of sides are shown as front and rear walls 20A, and the second pair of sides are shown as side walls 20B.

When the cup dispenser 10 engages the bottle 12, the liquid dispenser 16 extends through the opening 30 in the top panel 24. In a preferred embodiment, the top panel 24 is sized to have approximately the same dimensions as the base 18 of the bottle 12. In FIGS. 1–3, the side panels 26 extend downwardly from the substantially planar and substantially rectangular top panel 24. The side panels 26 extend over the side walls 20B, and each holder 32 is attached to a side panel 26.

Figure 4:
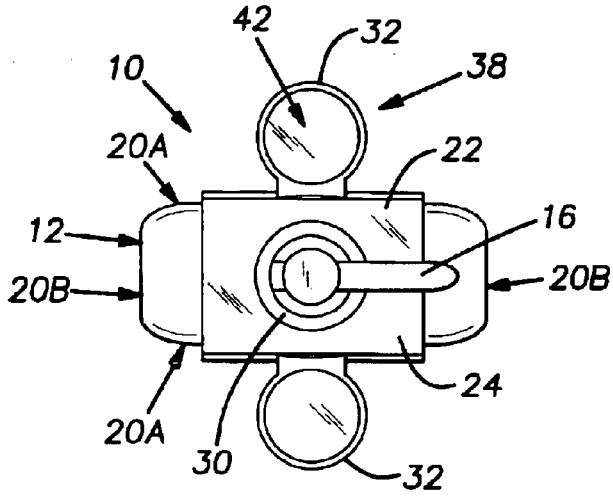
FIG. 4 is a top view of a cup dispenser according to one alternate embodiment of the invention.
Figure 5:
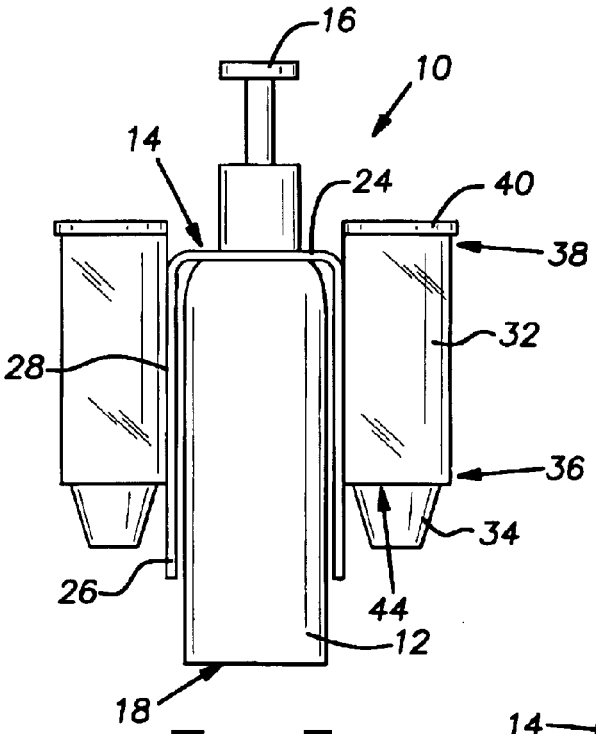
FIG. 5 is a side view of the cup dispenser of FIG. 4.
Figure 6:
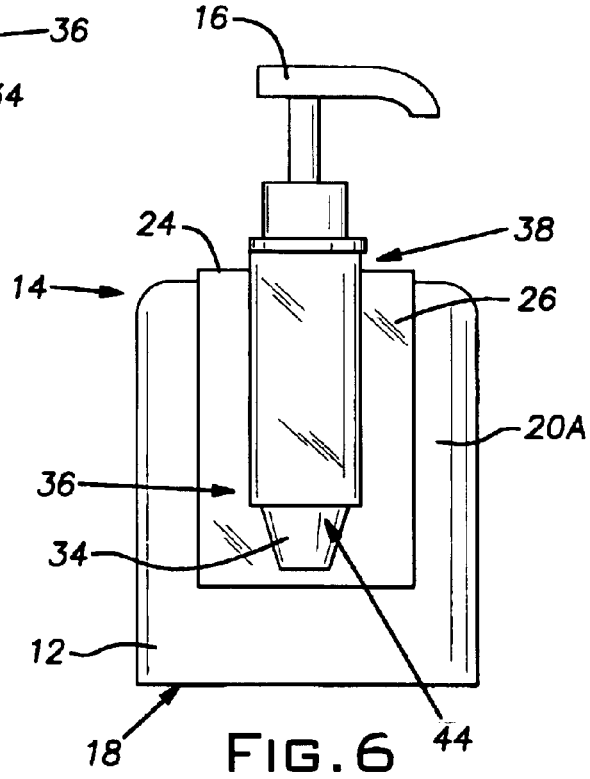
FIG. 6 is a front view of the cup dispenser of FIG. 4.

FIGS. 4–6 illustrate another preferred embodiment of the cup dispenser 10 sized to engage a bottle 12 similar in size and shape to the bottle 12 illustrated in FIGS. 1–3. In the embodiment illustrated in FIGS. 4–6, two side panels 26 extend downwardly from the top panel 24 over the front and rear walls 20A. Each side panel 26 has a holder 32 extending outwardly therefrom.

Figure 7:
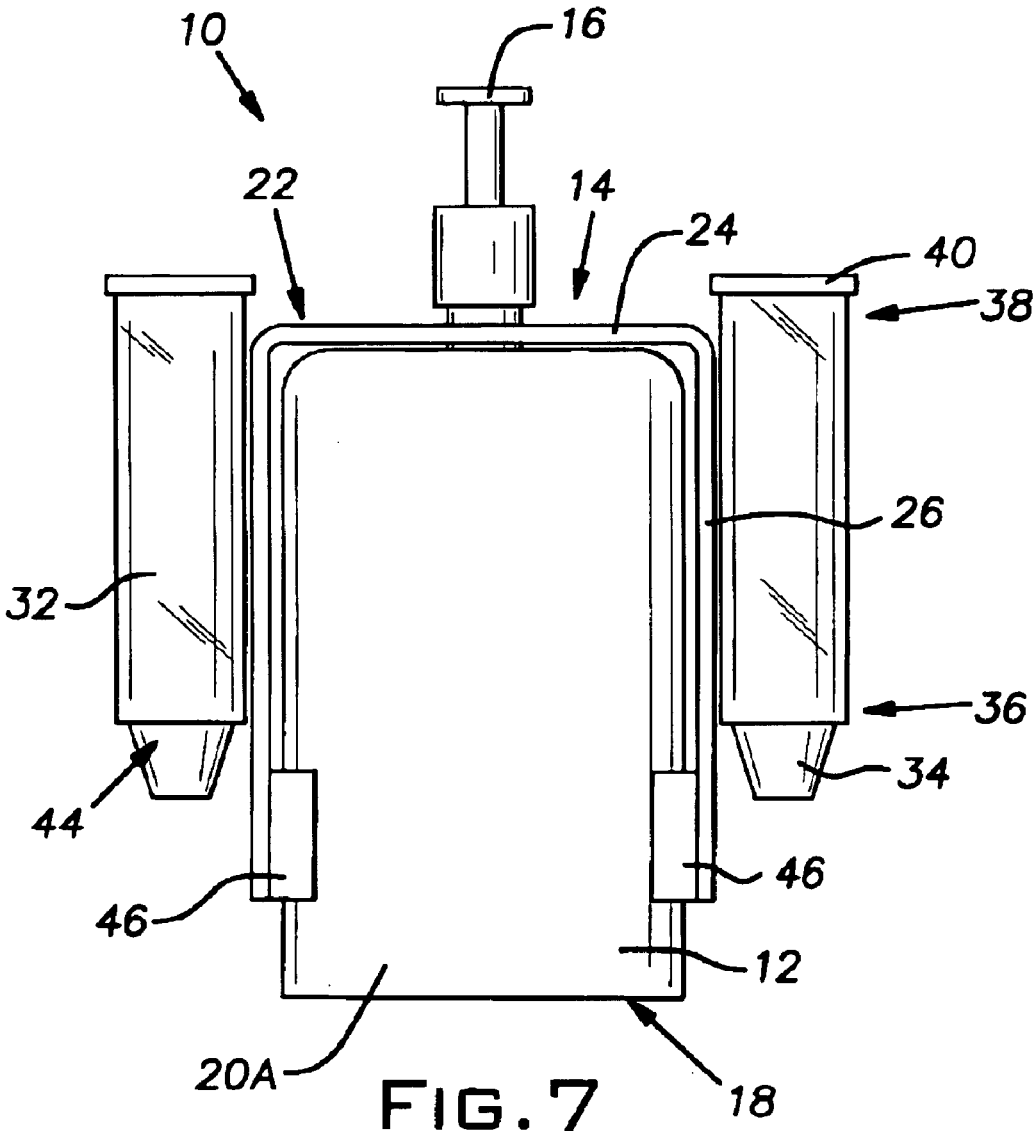
FIG. 7 is a front view of a cup dispenser according to one alternate embodiment of the invention.

FIG. 7 illustrates an alternate preferred embodiment of the cup dispenser 10 of FIGS. 1–3. In this alternate embodiment, brackets 46 extend from each side panel 26. The brackets 46 may cover a portion of one or more of the sides 20 of the bottle 12. In FIG. 7, the brackets 46 are shown as covering a portion of the front walls 20A. The brackets 46 engage one or more of the sides 20 of the bottle 12 and provide further stabilization for the cup dispenser 10 to prevent the cup dispenser 10 from wobbling or spinning about the liquid dispenser 16.

The embodiments illustrated in FIGS. 1–3, FIGS. 4–6, and FIG. 7 each have two holders 32, where one holder 32 extends from each side panel 26. However, other embodiments of the cup dispenser 10 may have only one holder 32. Embodiments having one holder 32 may be equipped with one or more side panels 26. Additional embodiments of the cup dispenser 10 of the present invention may be provided with more than two holders 32. Any of the side panels 26 may have more than one holder 32 extending therefrom. It is clear that cup dispensers 10 according to the present invention may be provided with multiple configurations of holders 32 and side panels 26.

Cup dispensers according to the present invention are preferably formed from thermoplastic materials, but may be formed from ceramics, metals, or other suitable materials. A transparent thermoplastic material is especially preferred. The cup dispenser is preferably shaped to mount over existing liquid dispensing bottles. The embodiments illustrated in FIGS. 1–3, FIGS. 4–6, and FIG. 7 have generally square corners, however, the corners may be rounded corners. The saddle configuration may be rectangular, as in the illustrated embodiments, or may be more rounded having a spherical or elliptical shape. The illustrated embodiments are configured to fit a rectangular bottle, but the cup dispenser of the present invention may also be shaped to fit cylindrical bottles. The size and shape of the cup dispenser will be determined by the size and shape of the dispensing bottle that the cup dispenser engages. For example, the cup dispenser can be configured to fit an 8 ounce dispensing bottle, or a 1 gallon dispensing bottle.

There are many advantages associated with the cup dispenser of the present invention. For example, in an oral care provider's facility, the cup dispenser saves space by not requiring a separate location for cup storage. Additionally, the cup dispenser conveniently provides a safer and more sanitary way to administer mouthwashes and other liquids using disposable cups. Restaurant patrons also could benefit from the cup dispenser of the present invention as it provides a convenient and sanitary method of providing courtesy mouthwash in restrooms. Courtesy mouthwash also could be provided in the restrooms of office buildings. A convenient and sanitary method of providing mouthwash is advantageous, as the benefits of mouthwash include decreasing the bacteria population in the mouth, leading to fresher breath and healthier teeth and gums. Furthermore, the outer surfaces of the cup dispenser could be used to provide advertising space in the aforementioned commercial settings.

The benefits of mouthwash could be more easily experienced by people in their homes, as using mouthwash would become simpler and more sanitary. Many people who use mouthwash in their homes utilize the cap as a cup, which creates unsanitary dispensing conditions. Disposable cup storage can be problematic in the home, and cup dispenser of the present invention can eliminate the convenience and sanitation concerns with home mouthwash use.

Although the invention has been shown and described with respect to certain preferred embodiments, equivalent alterations and modifications to the embodiments may be apparent to others skilled in the art upon the reading and understanding of this specification. The present invention is limited only by the scope of the following claims, and includes all such alterations, modifications, and equivalents.

What is claimed:

1. A cup dispenser for use with a bottle having a top with a liquid dispensing pump assembly mounted thereon, and a base connected to the top by one or more sides, the cup dispenser comprising:

a saddle comprising a top panel and one or more side panels connected to and extending downwardly from the top panel, the top panel and side panels cooperating to form a housing that covers the top of the bottle and at least a portion of a side of the bottle, the top panel having an opening sized to accommodate the liquid dispenser dispensing pump assembly of the bottle, wherein the top panel of the saddle engages the top of the bottle when the liquid dispensing pump assembly extends through the opening; and a holder extending from a side panel, the holder having a central cavity defined by a longitudinal axis wherein the holder has a dispensing end, and wherein the holder is configured to receive a plurality of cups.

2. The cup dispenser of claim 1 wherein the holder is cylindrical.

3. The cup dispenser of claim 1 wherein the holder further comprises a loading end opposite the dispensing end.

4. The cup dispenser of claim 3 wherein the dispensing end comprises a dispensing aperture sized to engage a cup while allowing the cup to pass through the dispensing aperture when force is applied to the cup, and wherein the loading end comprises a loading aperture sized to allow a vertical stack of cups to pass through the loading aperture.

5. The cup dispenser of claim 4 wherein the holder further comprises a removable cover that engages the loading end and covers the loading aperture, wherein the plurality of cups may be inserted into the holder through the loading aperture, and the cover attaches to the loading end of the holder to prevent unsanitary matter from contacting the cups while the cups are disposed within the holder.

6. The cup dispenser of claim 1 further comprising one or more additional holders extending from a side panel.

7. The cup dispenser of claim 1 further comprising one or more brackets extending from a side panel and covering a portion of a wall of the bottle, whereby the bracket holds the walls of the bottle adjacent to the side panels of the saddle.

8. The cup dispenser of claim 1 wherein the cup dispenser engages the bottle by inserting the liquid dispensing pump assembly through the opening in the top panel of the saddle, and wherein the cup dispenser may be removed from the bottle by lifting the saddle from the top of the bottle.

* * * * *